US006394772B1

(12) United States Patent
Larsen

(10) Patent No.: US 6,394,772 B1
(45) Date of Patent: May 28, 2002

(54) OIL TRANSFER PUMP

(76) Inventor: Bent Johan Larsen, Wallgreninkatu 22, FIN-06100 Porvoo (FI)

( * ) Notice: Subject to any disclaimer, the term of this patent is extended or adjusted under 35 U.S.C. 154(b) by 0 days.

(21) Appl. No.: 09/710,835

(22) Filed: Nov. 14, 2000

(51) Int. Cl.[7] ..... F04B 7/04
(52) U.S. Cl. ..... 417/490
(58) Field of Search ..... 417/490, 342, 417/347, 360

(56) References Cited

U.S. PATENT DOCUMENTS

| | | | | |
|---|---|---|---|---|
| 1,538,911 A | | 5/1925 | Taylor | |
| 2,818,029 A | | 12/1957 | Petzold | |
| 3,094,938 A | | 6/1963 | Blomeke et al. | |
| 4,276,001 A | * | 6/1981 | Holmes | 417/401 |
| 5,244,365 A | | 9/1993 | Catcher | |
| 5,328,296 A | * | 7/1994 | Lahar et al. | 405/68 |
| 5,334,001 A | * | 8/1994 | Williams | 417/360 |
| 5,338,464 A | * | 8/1994 | Marr | 210/776 |
| 5,356,114 A | | 10/1994 | Havard | |
| 5,406,019 A | * | 4/1995 | Dean | 588/249 |
| 5,611,300 A | * | 3/1997 | Gray, Jr. | 123/48 A |
| 5,616,009 A | * | 4/1997 | Birdwell | 417/342 |
| 5,792,350 A | * | 8/1998 | Sorley et al. | 210/242.3 |

FOREIGN PATENT DOCUMENTS

| | | |
|---|---|---|
| EP | 0 012 467 | 6/1980 |
| GB | 937647 | 9/1963 |

* cited by examiner

*Primary Examiner*—Teresa Walberg
*Assistant Examiner*—Vinod D. Patel
(74) *Attorney, Agent, or Firm*—Young & Thompson

(57) ABSTRACT

It is an object of the invention to provide a pump which comprises a body having an outlet recess and an oil inlet and an outlet, and an eccentric run by a motor, the eccentric moving by means of an arm an extrusion piston equipped with a closing clip, the extrusion piston compressing by means of oil a suspended piston having inside it a spring bushing and a spring pin which surrounds the spring pressing towards an end flange.

7 Claims, 4 Drawing Sheets

OIL TRANSFER PUMP

BACKGROUND OF THE INVENTION

The invention relates to a pump intended for oil spill recovery to pump oil or the like. The pump is suitable for installation in a small space in a collection apparatus. The problem with marketing small-scale oil collection apparatuses is that the available fixedly installable pumps which meet the requirements are size-wise unsuitable and very expensive in relation to the price of the actual apparatus. This is why oil transfer from small collection apparatuses is usually done using a low-pressure system located on the shore or onboard a vessel. A general problem with low-pressure systems is that when the oil is heavy, low-pressure is not necessarily enough to transfer it from the collector to the recovery container, but an apparatus using thrust pressure is required. For this purpose, it is necessary to have a pump which is light-weight, suitable in size, does not affect the buoyancy of the collection apparatus is inexpensive and pumps even the heavier oils as required.

SUMMARY OF THE INVENTION

It is an object of the invention to provide a piston pump which meets the set requirements. The pump body can be a pipe or the like. The body comprises an oil inlet and an oil outlet. Inside the body, two reciprocally working pistons, an extrusion piston and a suspended piston, are installed to produce together a smooth and efficient pumping motion for oil transfer. Between an eccentric run by a motor and the extrusion piston, there is an arm which produces the reciprocating motion of the extrusion piston. Inside the suspended piston, there is a spring bushing which guides a spring and keeps it in place when the piston moves. The suspended piston also works as a back-pressure valve of the pump. An end flange has a corresponding pin which acts as a support to the spring when it compresses. The extrusion piston has a closing clip for closing and opening the inlet. In the top part of the body, in connection with the inlet, there is an oil outlet recess which prevents the oil in front of the clip from being compressed and thus aids the oil in front of the clip to transfer back to the inlet. Between the suspended piston and the end flange, there is a spring which acts as a pressure equalizer of the pump and thus obtains from the suspended piston the counter-force which returns the suspended piston to its starting position when the oil chamber is empty. The pump works in such. a manner that the oil collected in the collection apparatus first runs into the inlet and when the extrusion piston moves away from the suspended piston, low-pressure is produced in the oil chamber. As a result of this, oil moves into the oil chamber after the closing clip moves away from the inlet. When the extrusion piston moves towards the suspended piston; the closing clip closes the inlet, after which the piston starts to press the oil against the suspended piston. Due to the pressure of the compressed oil, the suspended piston moves backwards on the spring enough to allow the oil to drain from the outlet. In idle run, air discharges in a corresponding manner. When the suspended piston moves away from the outlet, oil starts immediately to run from the oil chamber, pressure in the oil chamber decreases and the suspended piston returns back to its starting position and, at the same time, closes the outlet. The thrust force generated by the spring responds to the thrust force of the extrusion piston and the oil chamber empties. The closed outlet prevents the oil from returning back to the pump. This also produces the necessary discharge pressure required in pumping heavier oils. The torsional force of the motor should be measured so that it exceeds the low-pressure generated in the oil chamber. If the low-pressure caused by the extrusion piston moving backwards is proven to be too high in proportion to the torsional force of the motor, the low-pressure, can partly be decreased by narrowing the tip of the closing clip so that it is narrower towards the tip than at the root close to the extrusion piston. This way, the shape of the closing clip prevents the low-pressure in the oil chamber from becoming too high. Such a situation may occur when the oil chamber is large in proportion to the inlet. The extrusion piston and the suspended piston must not touch when the pump runs idle. A hydraulic or electric motor, for instance, can be used to generate the torsional force. The manufacturing material of the pump can vary as long as its composition meets the necessary requirements. The solution of the invention can be varied in a manner obvious to a person skilled in the art, for instance in such a manner that the outlet and inlet need not be round and the pistons can have gaskets in them. Other details, too, can be changed while remaining within the scope of the apparatus defined by the claims.

BRIEF DESCRIPTION OF THE DRAWINGS

In the following, the invention will be described with reference to the attached drawings which show an embodiment of the invention.

Figure 1A:
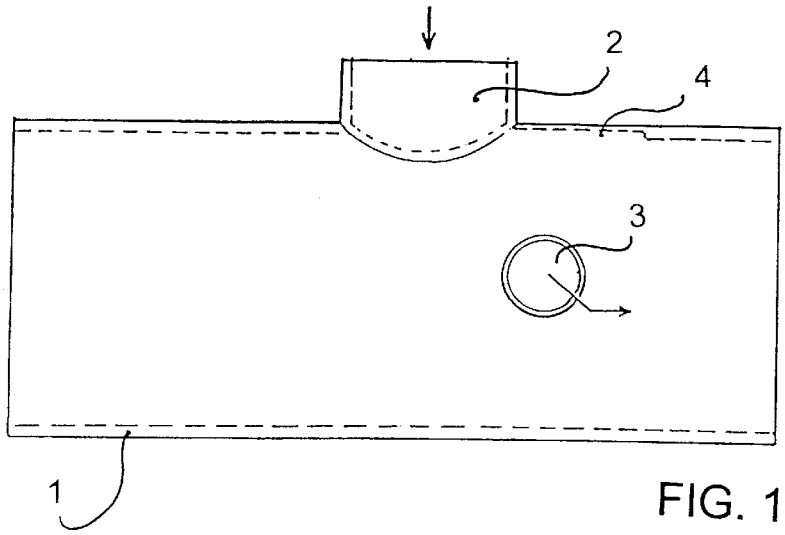
FIG. 1*a* shows a side view of a pump body (1) and an inlet (2), outlet (3) and oil outlet recess (4)
Figure 1B:
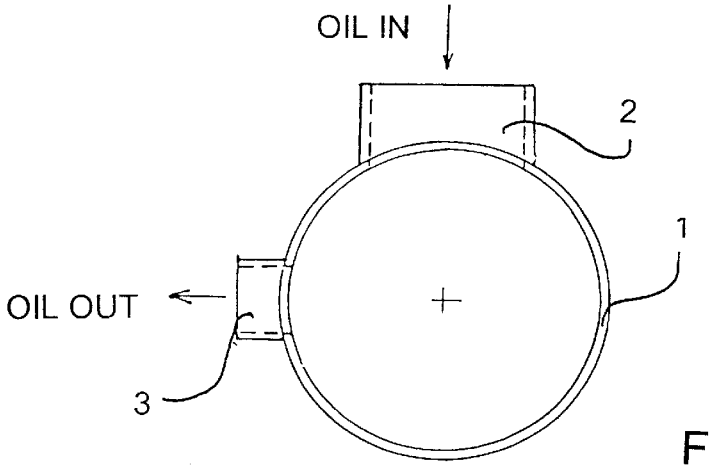
FIG. 1*b* shows an end view of the pump body (1) and the inlet (2) and outlet (3)
Figure 1C:
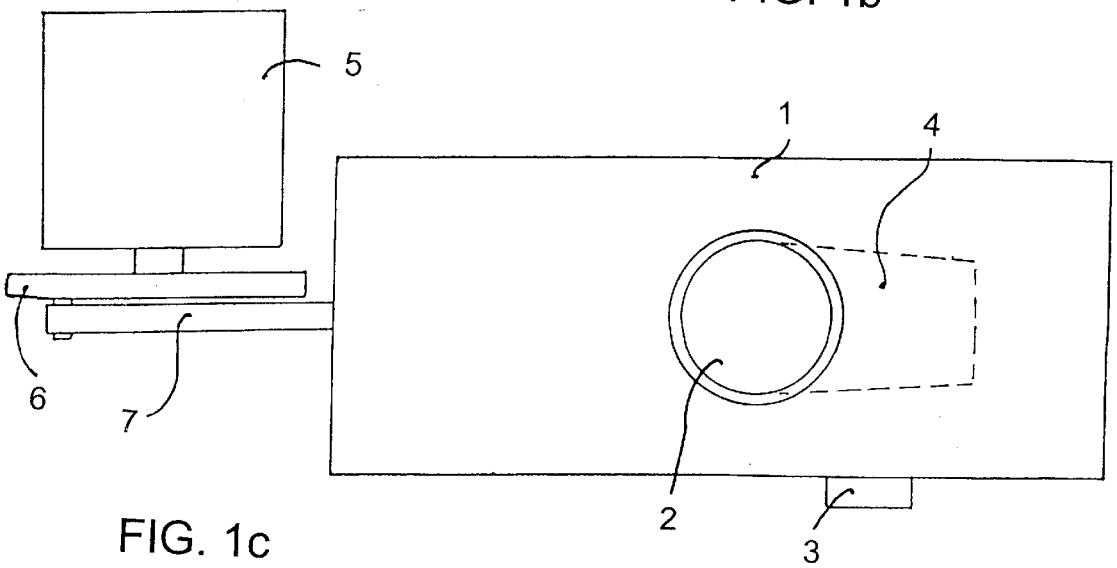
FIG. 1*c* shows a motor (5) running an eccentric (6) by means of an arm (7), and the pump body (1), inlet (2), outlet (3) and oil outlet recess (4)
Figure 2A:
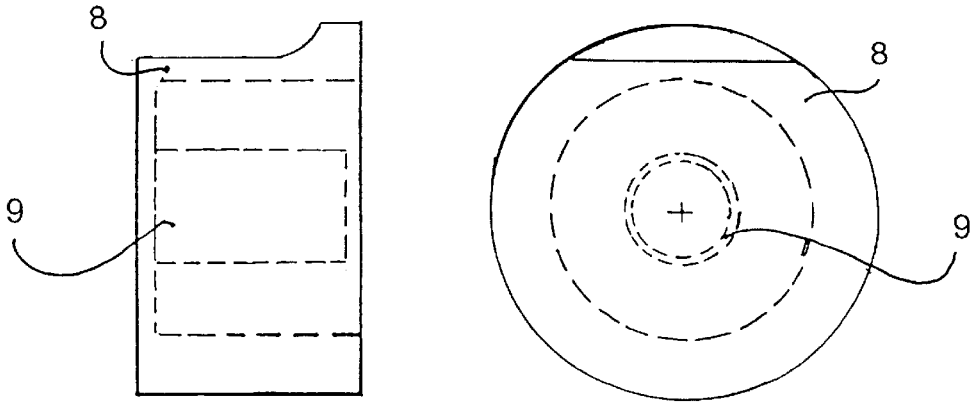
FIG. 2*a* shows a side and front view of a suspended piston (8) and a side view of a spring bushing (9)
Figure 2B:
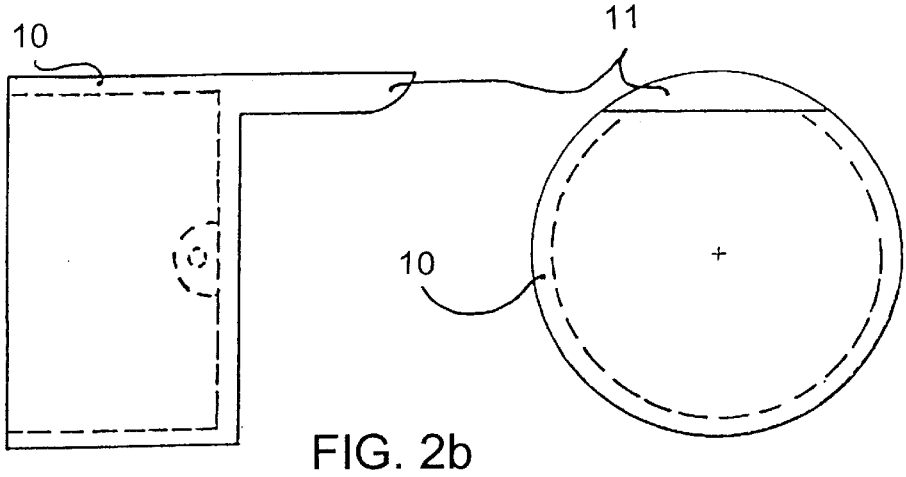
FIG. 2*b* shows a side and front view of an extrusion piston (10) and a closing clip (11)
Figure 2C:
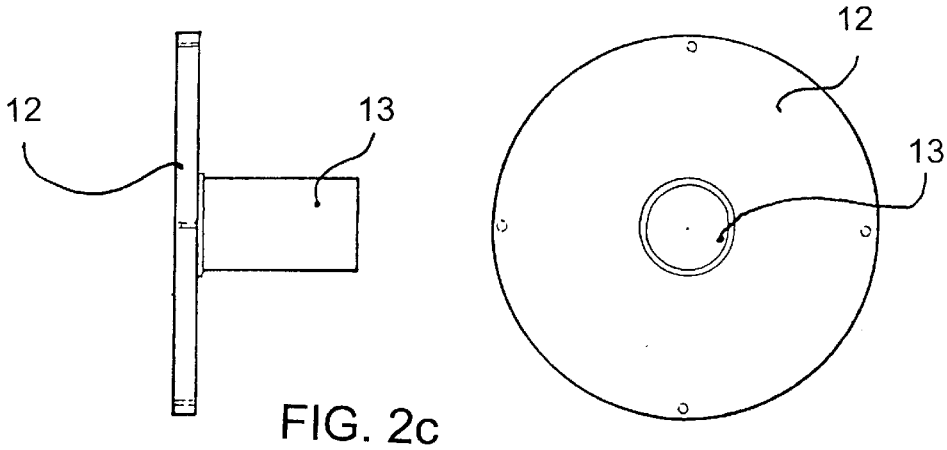
FIG. 2*c* shows a side and front view of an end flange (12).and a spring pin (13) belonging thereto.
Figure 3A:
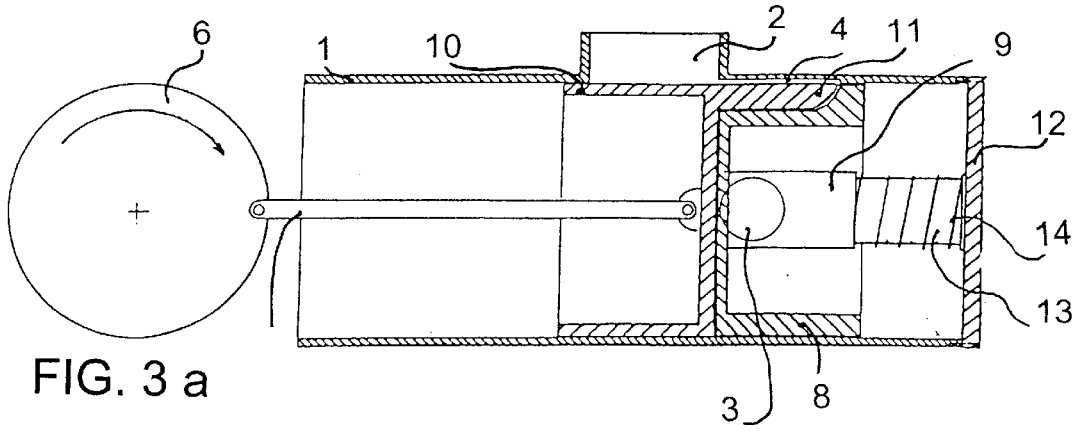
FIG. 3*a* shows a cross-sectional view of the pump in its starting position, the figure contains the following parts: body (1), inlet (2), outlet (3), oil outlet recess (4), eccentric (6), arm (7), suspended piston (8), spring bushing (9), extrusion piston (10), closing clip (11), end flange (12), pin (13) and spring (14)
Figure 3B:
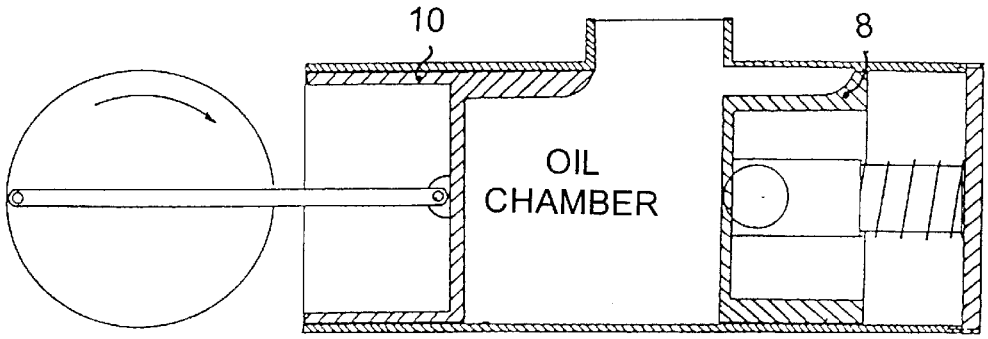
FIG. 3*b* shows a cross-sectional view of the suction position of the pump of FIG. 3*a* with the extrusion piston (10) having moved away from the suspended piston (8)
Figure 3C:
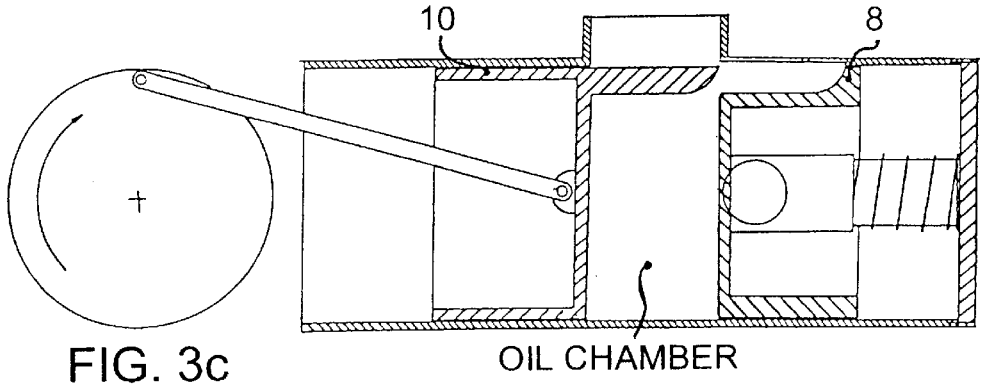
FIG. 3*c* shows a cross-sectional view of the thrust position of the pump of FIG. 3*a* with the extrusion piston (10) moving towards the suspended piston (8)
Figure 3D:
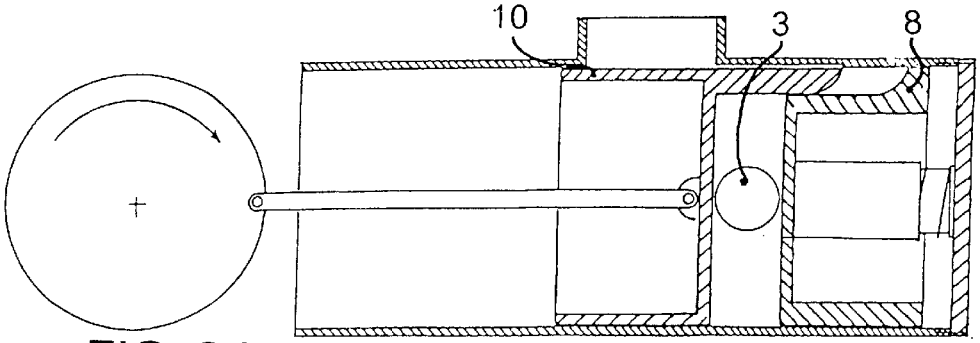
FIG. 3*d* shows a cross-sectional view of the compression position of the pump of FIG. 3*a* with the extrusion piston (10) moving the suspended piston (8) away from the outlet (3)
Figure 4A:
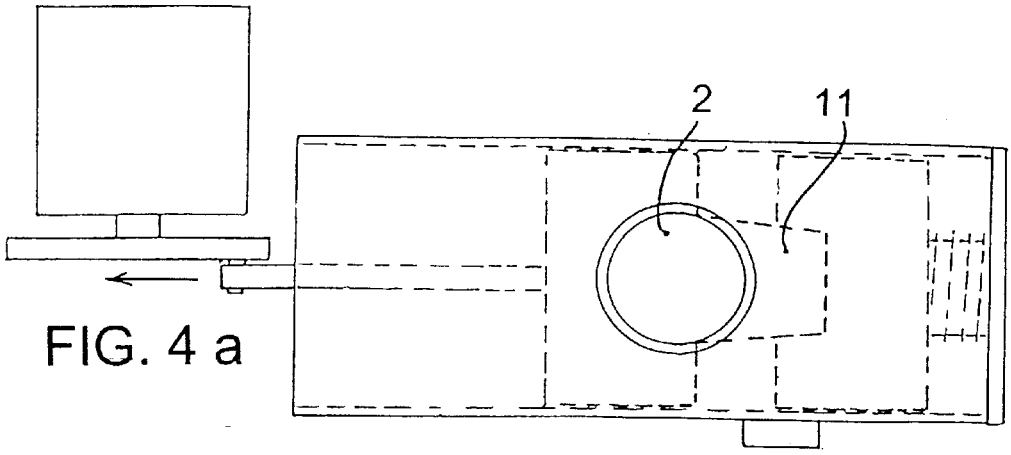
FIG. 4*a* shows a top view of the pump with the clip (11) opening the inlet (2)
Figure 4B:
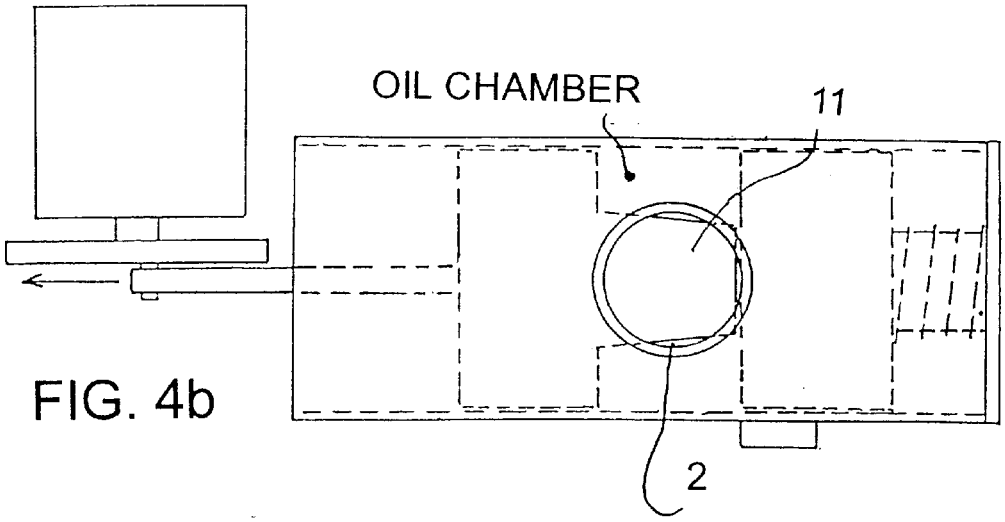
FIG. 4*b* shows a top view of the pump with the narrowed clip (11) having partly opened the inlet (2)
Figure 4C:
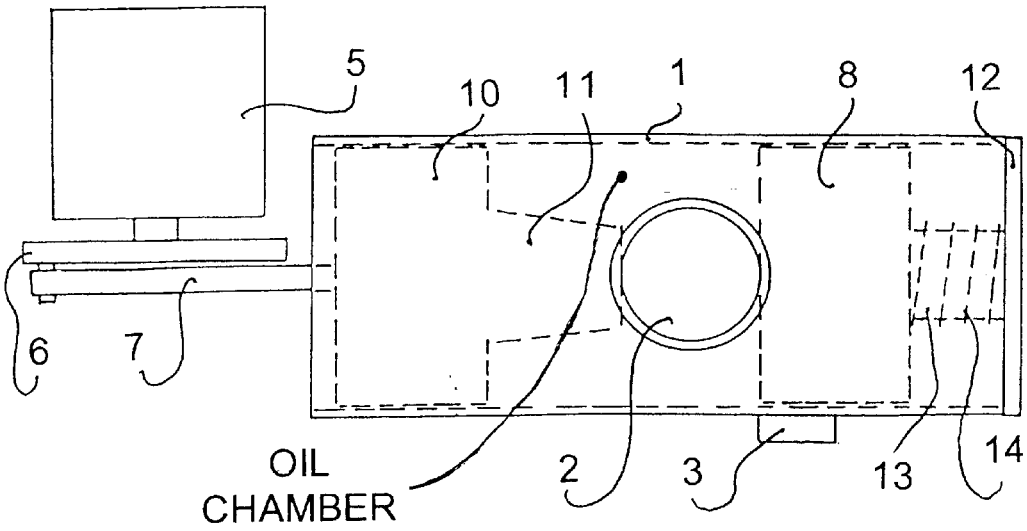
FIG. 4*c* shows a top view of the pump with the clip (11) completely away from the inlet (2), the figure shows the body (1), inlet (2), outlet (3), motor (5), eccentric (6), arm (7), suspended piston (8), extrusion piston (10), clip (11), end flange (12), pin (13) and spring (14).

It should be understood that the above description and the accompanying drawings only illustrate one embodiment of the invention. It will be obvious to a person skilled in the art that the invention can be varied and modified in may ways without deviating from the scope of the attached claims. Thus, for instance the pump of the present invention can be used for pumping other fluids than oil.

What is claimed is:

1. A pump having a motor and an eccentric connected to its body, the eccentric having an arm fastened to it to move a piston inside the body, wherein the extrusion piston is equipped with a closing clip and said piston generates by means of compressed fluid in a fluid chamber a movement of a suspended piston, which moves the suspended piston away from an outlet.

2. A pump as claimed in claim 1, wherein when the suspended piston moves away from the outlet and the pressure decreases in the fluid chamber, the suspended piston starts by counter-force of a spring to press fluid towards the extrusion piston.

3. A pump as claimed in claim 1, wherein the suspended piston acts as a closing valve.

4. A pump as claimed in claim 1, wherein the compressed fluid in the fluid chamber opens the outlet.

5. A pump as claimed in claim 1, wherein a fluid outlet recess is located in a top part of the body.

6. A pump as claimed in claim 1, wherein a narrowed closing clip reduces a low-pressure and the suspended piston has a recess suited for the closing clip.

7. A pump as claimed in claim 1, wherein the pump comprises a spring which returns the suspended piston in front of the outlet when the pressure in the fluid chamber has decreased due to the opening of the outlet.

* * * * *